US007007902B1

(12) United States Patent
Root

(10) Patent No.: US 7,007,902 B1
(45) Date of Patent: Mar. 7, 2006

(54) ADJUSTABLE SUPPORT FOR HANDS AND ARMS

(76) Inventor: Warren N. Root, 24921 Muirlands, Unit 112, Lake Forest, CA (US) 92630-4831

( * ) Notice: Subject to any disclaimer, the term of this patent is extended or adjusted under 35 U.S.C. 154(b) by 0 days.

(21) Appl. No.: 10/907,853

(22) Filed: Apr. 18, 2005

Related U.S. Application Data

(63) Continuation-in-part of application No. 10/761,785, filed on Jan. 21, 2004, now Pat. No. 6,936,022.

(60) Provisional application No. 60/442,613, filed on Jan. 23, 2003, provisional application No. 60/573,906, filed on May 24, 2004.

(51) Int. Cl.
*B43L 15/00* (2006.01)

(52) U.S. Cl. ..... 248/118.3; 248/918; 602/21

(58) Field of Classification Search ..... 248/118, 248/118.1, 118.3, 118.5, 918; 602/20, 21
See application file for complete search history.

(56) References Cited

U.S. PATENT DOCUMENTS

| | | | | |
|---|---|---|---|---|
| 0,591,800 | A | 10/1897 | Finnblade et al. | 84/469 |
| 0,679,288 | A | 7/1901 | Bohrer | 84/469 |
| 3,782,719 | A | 1/1974 | Kuhlman | 482/48 |
| 5,004,196 | A * | 4/1991 | Gross | 248/118.3 |
| 5,082,258 | A | 1/1992 | Niks | 84/469 |
| 5,108,057 | A * | 4/1992 | Dandy et al. | 248/118 |
| 5,158,256 | A | 10/1992 | Gross | 248/118.3 |
| 5,161,760 | A * | 11/1992 | Terbrack | 248/118 |
| 5,398,896 | A | 3/1995 | Terbrack | 248/118.5 |
| 5,876,362 | A | 3/1999 | Root | 602/21 |
| 5,915,655 | A * | 6/1999 | Gutowski | 248/118.5 |
| 5,944,289 | A * | 8/1999 | Speece | 248/118.5 |
| 6,217,537 | B1 | 4/2001 | Root | 602/21 |
| 6,936,022 | B1 | 8/2005 | Root | |
| 2001/0009263 | A1 | 7/2001 | Chou | 248/118 |
| 2002/0130226 | A1 * | 9/2002 | Nogueira | 248/118.5 |

* cited by examiner

*Primary Examiner*—Ramon O Ramirez
(74) *Attorney, Agent, or Firm*—Jerry Turner Sewell

(57) ABSTRACT

A system and method support the forearm and hand of a user performing repetitive tasks. In one embodiment, the system includes a support bar having a low friction upper surface. First and second cradles are coupled to the support bar to receive and support a user's hands and lower forearms. The cradles have curved bottom surfaces that rest upon the curved upper surface of the support bar to provide a small, low-friction contact area, which enables the user's arms and hands to move effortlessly forward and backwards and left and right. The cradles also tilt and swivel with respect to the support bar. The system and method reduce strains on the arms and shoulders of the user by supporting at least a portion of the weight of the user's arms and hands while the user performs the repetitive tasks.

10 Claims, 9 Drawing Sheets

ADJUSTABLE SUPPORT FOR HANDS AND ARMS

RELATED APPLICATIONS

The present application is a continuation-in-part of U.S. patent application Ser. No. 10/761,785, filed on Jan. 21, 2004 (now U.S. Pat. No. 6,936,022), which claims the benefit of priority under 35 U.S.C. § 119(e) of U.S. Provisional Application No. 60/442,613, filed on Jan. 23, 2003. The present application also claims the benefit of priority under 35 U.S.C. § 119(e) of U.S. Provisional Application No. 60/573,906, filed on May 24, 2004.

BACKGROUND OF THE INVENTION

1. Field of the Invention

The present invention is in the field of devices that provide support to the lower arm, wrists and hands during the performance of repetitive tasks, such as typing and data entry.

2. Description of the Related Art

Many personal and job-related tasks involve the use of computer keyboards, calculators and other data entry devices, which require a person to have his or her arms and hands extended in front of the person's body for long durations. In addition, other tasks, such as assembly work, sewing, needlework, knitting, painting, or the like, require the arms and hands to be likewise extended.

As a result of repeated periods of arm and hand extension, many persons have developed injuries such as carpal tunnel syndrome. In addition, because of aging, accidents, or certain diseases, some persons no longer have the ability to perform relatively simple tasks which require arm and hand extension.

A number of devices have been developed to reduce the effects of such extension. For example, wrist pads are available to place in front of a keyboard to elevate the wrists and thereby change the angle of the hands with respect to the keyboard. Such wrist pads do not however assist the user when the user has to move his or her hands from side-to-side on the keyboard. In particular, if a person has weak muscles or the like, the person may be unable to move freely about the keyboard. Thus, additional assistance for using keyboards and for performing other tasks requiring arm and hand extension is desirable.

Earlier solutions for providing support for a person's hands and arms are illustrated in U.S. Pat. Nos. 5,876,362 and 6,217,537 issued to Warren N. Root, which are incorporated by reference herein.

SUMMARY OF THE INVENTION

An aspect in accordance with an embodiment of the present invention is a system for supporting the forearms and hands of a user performing repetitive tasks. The system comprises a horizontal support bar having a curved upper surface. At least the upper surface comprises a low-friction material. First and second cradles are loosely coupled to the support bar for independent movement with respect to the upper surface of the support bar. Each of the first and second cradles comprises a first portion to support the lower portion of the forearm of a user. The first portion has a curved lower surface that has a small area of contact with the curved upper surface of the support device. Each of the cradles further comprises a second portion to support the hand of the user.

Another aspect in accordance with an embodiment of the present invention is a method for reducing strains on the arms and shoulders of a user performing repetitive tasks such as typing and data entry. The method comprises positioning a support bar proximate a keyboard and generally in parallel to the front edge of the keyboard. The support bar has an upper surface comprising a low-friction material. The method further comprises mounting a first cradle and a second cradle on the support bar. The cradles are loosely coupled to the support bar to enable free and independent movement of the cradles with respect to the support bar. Each cradle has a forearm support portion to support a user's forearm and a hand support portion to support a user's hand. The method further comprises positioning the user's left forearm in the forearm support portion of the first cradle such that the user's left hand is supported by the hand support portion of the first cradle with the fingers of the left hand proximate a keyboard. The first cradle supports at least a portion of the weight of the user's left arm and left hand while the user performs the repetitive tasks. The method further comprises positioning the user's right forearm in the forearm support portion of the second cradle such that the user's right hand is supported by the hand support portion of the second cradle with the fingers of the right hand proximate the keyboard. The second cradle supports at least a portion of the weight of the user's right arm and right hand while the user performs the repetitive tasks.

BRIEF DESCRIPTIONS OF THE DRAWINGS

Embodiments in accordance with the present invention are described below in connection with the accompanying drawing figures in which.

DETAILED DESCRIPTION OF THE PREFERRED EMBODIMENTS

Figure 1:
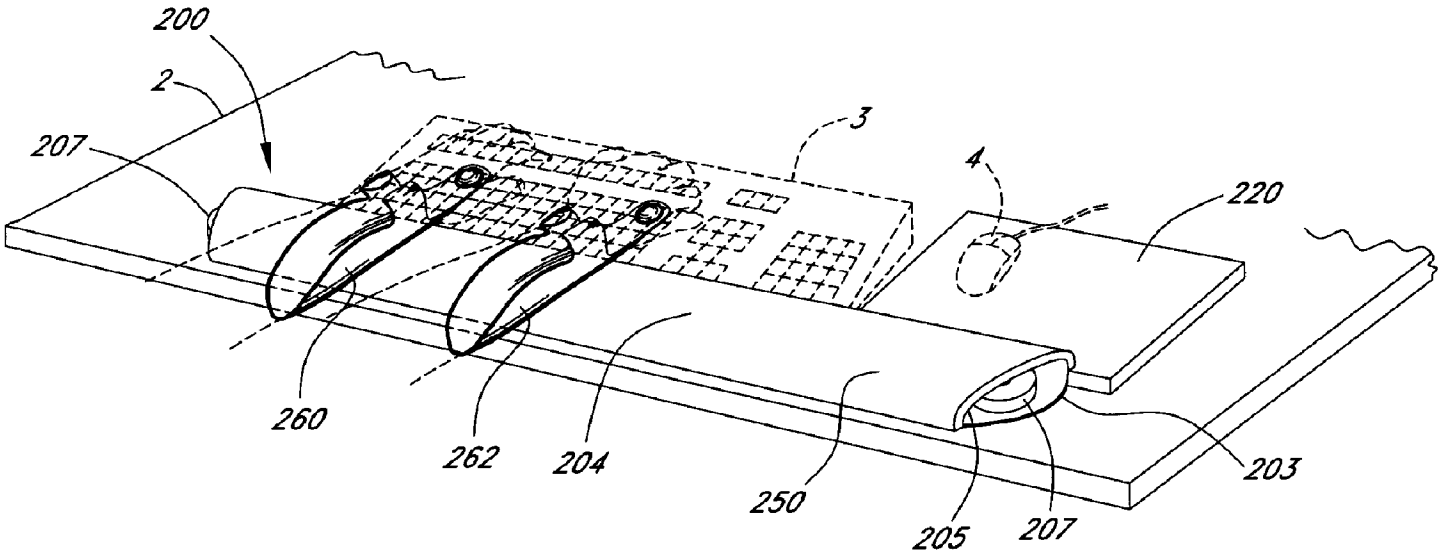
FIG. 1 illustrates a perspective view of an embodiment of the cradles, the adjustable pad and the mouse pad, and further illustrates in phantom the position of a keyboard and a pointing device (mouse) with respect to the adjustable pad.

As shown in FIG. 1, an adjustable pad assembly 200 rests on a generally horizontal supporting surface 2 proximate to a keyboard 3 and a pointing device (e.g., a mouse) 4. The supporting surface 2 may advantageously be the upper surface of a desk, a workstation, a table, or the like. The supporting surface 2 may also advantageously be the upper surface of a fixed or adjustable keyboard tray attached to a desk or workstation.

The adjustable pad assembly 200 comprises a generally horizontal wrist support pad 204. The support pad 204 has a length (parallel to a front edge of the supporting surface 2) of approximately 24 inches. The support pad 204 has a width (or depth) from a front edge (proximate the edge of the supporting surface) to a rear edge (proximate the keyboard 3) of approximately 3 inches. As discussed below, the height of the wrist support pad 204 is adjustable. In one advantageous embodiment, the height is adjustable from approximately 1 inch to approximately 1.25 inches. The foregoing dimensions and the other dimensions discussed herein are provided by way of example and are not intended to be limiting.

The support pad 204 comprises a base portion 203 and an upper portion 205. In the embodiment illustrated in FIG. 2A, the base portion 203 and the upper portion 205 are formed from a single (e.g., unitary) sheet of material, such as, for example, aluminum, plastic, or the like. The sheet of material is bent into a generally "U"-shaped form so that the upper portion 205 is generally parallel to the base portion 203. In the illustrated embodiments, the "bottom" of the "U" forms the rear edge of the support pad 204 and the two ends of the "U" are proximate the front edge of the support pad 204.

The base portion 203 is generally planar (e.g., flat) so that the base portion 203 rests evenly on the supporting surface 2. In preferred embodiments, at least a portion of the bottom of the base portion 203 is coated with a conventional non-skid material so that the pad assembly 200 generally remains in one position on the supporting surface 2 unless deliberately moved by a user.

Figure 2A:
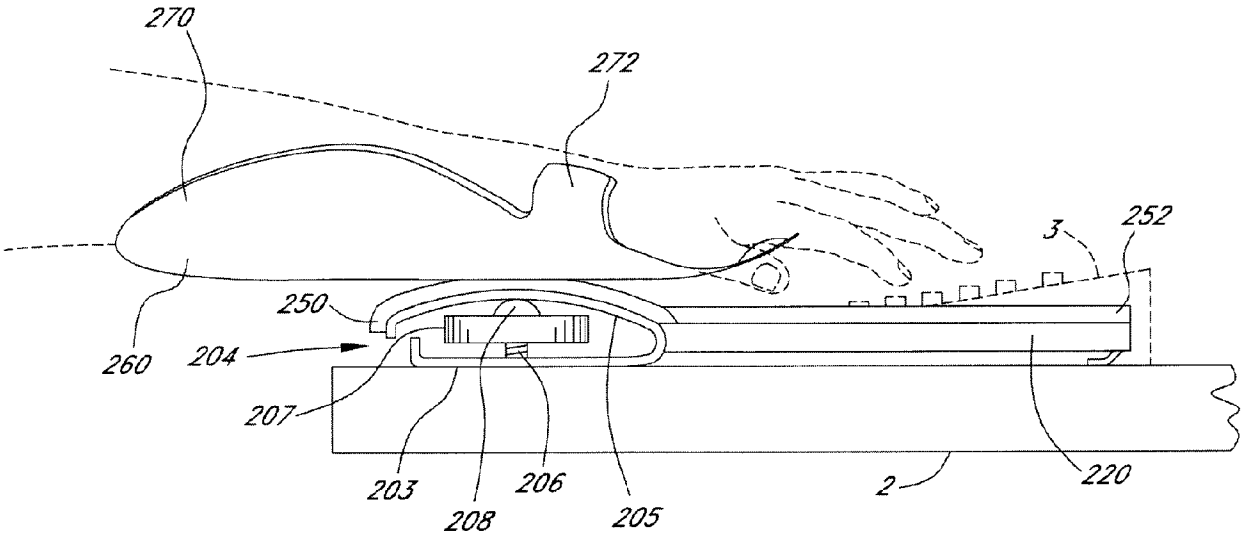
FIG. 2A illustrates an end view of an embodiment of the support system of FIG. 1 having a unitary base portion and upper portion, and further illustrates an embodiment of a wrist cradle positioned on the adjustable pad.

As illustrated in FIG. 2A, the upper portion 205 preferably has a convex cross section taken across the upper portion 205 in the direction of the width of the pad assembly 200 so that the top surface of the upper portion 205 is curved. In particular, the height of the exposed surface of the upper portion increases from the front edge of the exposed surface to a location approximately in the middle of the exposed surface. The height of the exposed surface decreases from the approximate middle of the exposed surface to the rear edge of the exposed surface.

The convex cross section of the upper portion 205 may be considered to be more aesthetically pleasing to some users. In addition, the contour of the upper portion 205 is beneficial to the smooth operation of the pad assembly 200, as will be discussed in more detail below.

In the embodiment of FIG. 2A, the support pad 204 comprises a deformable material that can be shaped as shown in FIG. 2A. The material has "memory" so that when the material is deformed in response to force, the material returns to the original shape when the force is removed. When an upward force is applied to the upper portion 205, front edge of the upper portion moves upward away from the front edge of the base portion 203. The upper portion 205 returns to the original position when the force is removed.

In FIGS. 1 and 2A, force to selectively displace the upper portion 205 is provided by a pair of height-adjustment wheels 207. One of the wheels 207 is positioned proximate a first end (left end in FIG. 1) of the base portion 203, and the other of the wheels 207 is positioned proximate a second end (right end in FIG. 1) of the base portion 203. In particular, as shown in FIG. 2A, each wheel 207 has internal threads (not shown) that engage the threads of a threaded stud 206. The stud 206 is oriented perpendicular to the base portion 203 and has a lower end secured to the base portion 203. The wheel 207 is threaded onto an upper end of the stud 206.

Preferably, the wheel 207 has a cap 208 that engages the inside surface of the upper portion 205 at approximately the middle of the upper portion 205 where the inner surface of the upper portion 205 is displaced by the farthest distance from the lower portion 203. In preferred embodiments, the cap 208 is formed with a low-friction surface so that rotation of the wheel 207 is not significantly inhibited by friction between the cap 208 and the inner surface of the upper portion 205.

Rotation of the wheel 207 causes the wheel 207 to move up or down with respect to the stud 206. For example, the wheel 207 is at an uppermost position when the threads of the wheel 207 engage a small number of threads at the top of the stud 206. The wheel 207 reaches a lowermost position when the top of the stud 206 engages an inside surface (not shown) of the cap 208. The thickness of the wheel 207 is advantageously selected to enable the wheel to travel approximately 0.25 inch.

As the wheel 207 is rotated in a first direction (e.g., counterclockwise looking down at the cap 208), the cap 208 will displace the exposed surface of upper portion 205 farther away from the base portion 203, thus increasing the height of the adjustable pad 204 with respect to the supporting surface 2. As the wheel 207 is rotated in a second direction (e.g., clockwise), the "memory" of the elastic material returns the material to the original shape to reduce the displacement of the upper portion 205, thus decreasing the height of the exposed surface of the upper portion 205. A user rotates the wheels 207 to select a desired height for the exposed surface of the upper portion 205.

As discussed above, the cap 208 engages the upper portion 205 at approximately the middle of the upper portion 205 where the distance between base portion 203 and the upper portion 205 is the greatest. Thus, adjustment of the wheels 207 effectively adjusts the highest point of the upper portion. The locations of the studs 206 could be moved toward the rear edge of the adjustable pad 204 so that the vertical movement of the wheels 207 causes a greater vertical movement of the upper portion 205.

Figure 2B:
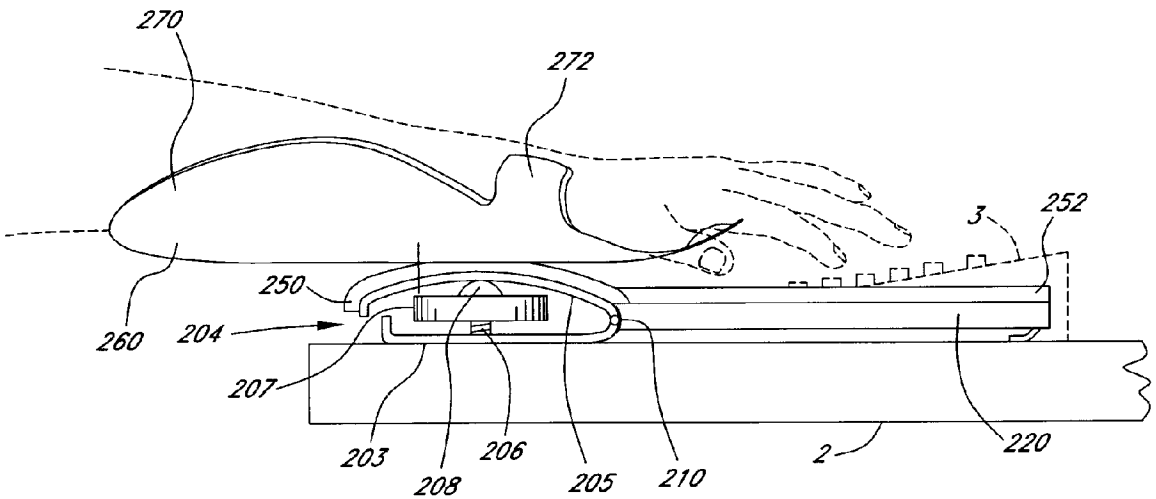
FIG. 2B illustrates an end view of an alternative embodiment of the support system of FIG. 1 having an upper portion coupled to the base portion by a hinge or other suitable coupling system.

In another embodiment illustrated in FIG. 2B, the base portion 203 and the upper portion 205 are formed separately and are pivotably coupled at the rear edge of the adjustable pad 204 by a hinge 210 or other suitable pivotal connecting system. For example, the hinge 210 may advantageously comprise a piano hinge that extends substantially the entire length of the adjustable pad 204. Alternatively the hinge 210 may advantageously comprise a plurality of shorter hinges.

The embodiment of FIG. 2B advantageously eliminates the acute bend required at the read edge of the adjustable 204 in FIG. 2A. The embodiment of FIG. 2B may also comprise different materials for the upper portion 205 and the base portion 203. The embodiment of FIG. 2B also allows the upper portion 205 to be displaced further from the base portion 203 such that the inner surface of base portion 203 may be used for storing small items (e.g., pencils, pens, paper clips, stick-on note pads, etc.).

The embodiment of FIG. 2B operates in substantially the same manner as the embodiment of FIG. 2A in response to the rotation of the adjustment wheels 207; however, unlike the embodiment of FIG. 2A, the embodiment of FIG. 2B relies on gravity, rather than the elasticity of the material, to lower the upper portion 205 when the wheels 207 are lowered. Thus, the material used to form the upper portion 205 and the lower portion 203 may be a rigid material.

Figure 5:
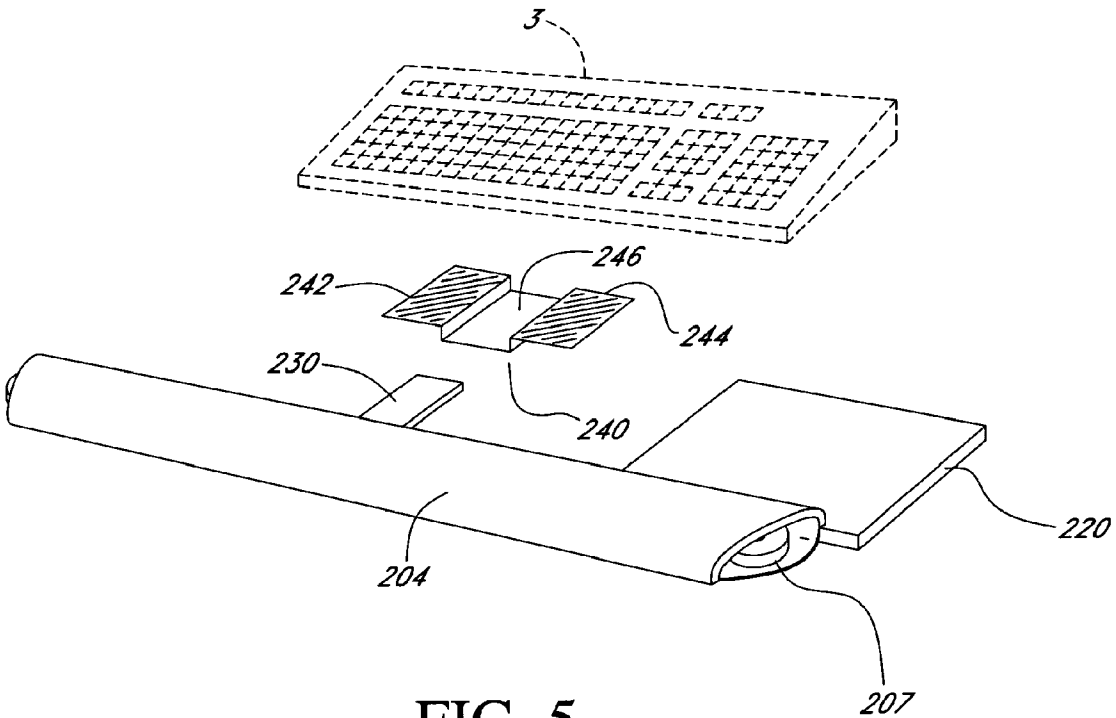
FIG. 5 illustrates an embodiment of the adjustable pad that further includes an apparatus for positioning a keyboard with respect to the adjustable pad.

As shown in FIG. 5, certain embodiments of the pad assembly 200 include an attached pointer support platform 220 positioned at one end (e.g., the right end in FIG. 1) of the adjustable pad 204. The pointer support platform 220 supports the mouse 4 or other pointing device. The pointer support platform 220 may be integral with the adjustable pad 204 (e.g., secured to the adjustable pad 204). Alternatively, the pointer support pad 220 may include positioning devices (not shown), such as, for example, tabs to engage slots in the adjustable pad 204, so that the pointer support platform 220 may be temporarily engaged with the adjustable pad 204 and subsequently removed.

In other embodiments, the adjustable pad 204 can be provided without an attached or attachable pointer support platform 220. A user may position a conventional mouse pad proximate to an end of the adjustable pad 204 so that the benefits of the adjustable pad 204 may be utilized in combination with the conventional mouse pad.

It will be understood that in any alternative, the pointer support platform 220 or a conventional mouse pad can also be positioned at the left end of the adjustable pad 204 to accommodate left-handed users and other users wanting the mouse pad at that location.

The pad assembly 200 may be used with conventional keyboards without modifying the keyboard. On the other hand, a user may want to have the pad assembly 200 remain in substantially the same position with respect to the keyboard 3 so that the positions of the keys are known with respect to the positions of the user's hands on the adjustable pad 204. FIG. 5 illustrates an embodiment of the pad assembly 200 that includes a positioning device that requires minimal modification of the keyboard 3. In particular, the pad assembly 200 includes a tab 230 that extends generally perpendicularly from the rear edge of the adjustable pad 204. The tab 230 comprises a thin material (e.g., metal or plastic) and is disposed in a plane generally parallel to the supporting surface 2 when the pad assembly is resting on the supporting surface 2. The plane of the tab 230 may be a short distance (e.g., 0.05 inch) above the supporting surface 2.

A rectangular bracket assembly 240 is provided to attach to the underside of a conventional keyboard (e.g., the keyboard 3). The bracket assembly 240 is shaped to have a first attachment portion 242 and a second attachment portion 244 and a middle portion 246. As illustrated, the first and second attachment portions 242, 244 are in a common plane. The middle portion 246 is in a second plane, which is displaced below the common plane by an amount generally corresponding to the thickness of the tab 230. The bracket assembly 240 is positioned on the underside of the keyboard 3 with the boundaries between the attachment portions and the middle portion perpendicular to the front edge of the keyboard. Respective upper surfaces of the attachment portions 242, 244 advantageously are coated with an adhesive (not shown) that secures the upper surfaces to the underside of the keyboard 3 in a conventional manner. It will be appreciated that the surfaces may be advantageously coated with a high-tensile pressure-sensitive adhesive and covered with a peel strip for delivery to a user. The user removes the peel strip just prior to attaching the bracket assembly 240 to the keyboard 3.

When the bracket assembly 240 is secured to the keyboard 3 in the foregoing manner, the middle portion 246 of the bracket assembly 240 and the underside of the keyboard 3 form a cavity into which the tab 230 of the pad assembly 200 can be inserted. The width and the displacement of the middle portion 246 are sized with respect to the tab 230 so that the tab 230 is snugly engaged within the cavity. With the tab engaged in the tab 230, the keyboard 3 does not readily move with respect to the pad assembly 200 in response to usual typing movements and forces. On the other hand, the keyboard 3 may be readily disconnected from the pad assembly 200 by applying a force perpendicular to the respective edges of the keyboard 3 and the pad assembly 200 in the plane of the tab 230 to pull the tab 230 out of the cavity.

The upper portion 205 of the adjustable pad 204 is covered with a low friction, durable cover material 250. For example, in a preferred embodiment, the cover material 250 comprises a neoprene material such as, for example, wetsuit material. The cover material 250 is bonded to the curved upper portion 205 using a suitable adhesive material (e.g., epoxy glue or the like) compatible with the neoprene material.

The pointer support platform 220 may also be covered with a suitable cover material 252. For example, the cover material 252 for the pointer support platform 220 may comprise the neoprene wetsuit material discussed above with respect to the cover material 250. Other materials may also be used. In a further alternative, the pointer support platform 220 may not include a cover material. A user can place a commercially available mouse pad of the user's choice on over the pointer support platform 220.

FIG. 1 further illustrates a first cradle 260 for a user's left arm, wrist and hand and a second cradle 262 for a user's right arm, wrist and hand. The cradles 260, 262 may comprise metal or molded plastic configured to conform to the palm, wrist and forearm of the user. The two cradles 260, 262 could be configured differently for the user's left and right hands; however, in the illustrated embodiment, the two cradles 260, 262 are substantially identical and are interchangeable. Thus, the following description of the left cradle 260 is also applicable to the right cradle 262.

As shown in FIG. 2 for the left cradle 260, the user positions a cradle on the lower forearm, wrist and palm of the hand. The cradle 260 comprises a forearm support portion 270, an integral flexible bracelet clip 272 and a palm support 274. The forearm support portion 270 is generally arcuate and is sized to receive the lower forearm of the user. The clip 272 is positioned in a middle region of the cradle 260 where the lowermost end of the user's forearm rests in the forearm support portion 270. The palm support 274 extends from the forearm support portion 270 so that the palm support 274 is positioned beneath the user's palm.

The clip 272 is sized to fit partially around the lowermost end of the user's forearm to provide a snug, but not tight, fit. The clip 272 keeps the cradle 260 in place as the user moves the left hand. In alternative embodiments (not shown) the cradle 260 can be attached to the wrist using a hook and pile fastening system (e.g., VELCRO® tape). Other fastening systems may also be used.

Figure 4A:
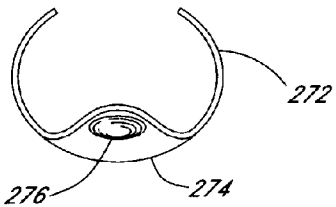
FIG. 4 illustrates an end view of the wrist cradle of FIG. 3.
Figure 4B:
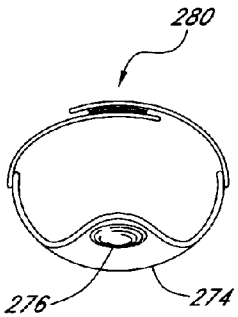
Figure 3:
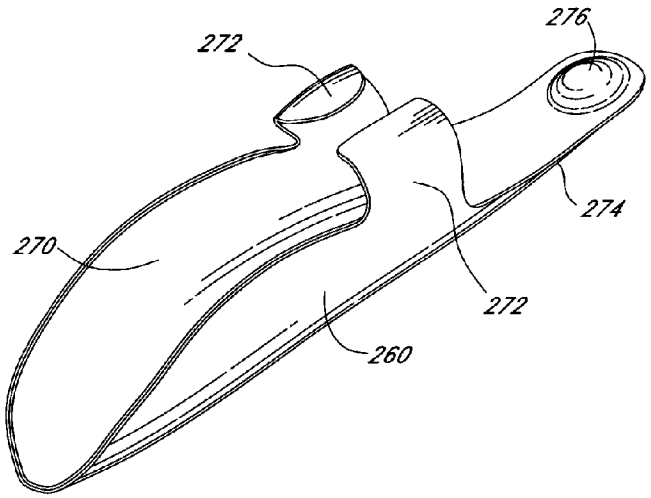
FIG. 3 illustrates a perspective view of an embodiment of the wrist cradle.

The palm support 274 has a narrow, spoon-like shape. In particular, the palm support 274 includes a raised portion 276 that is shown more clearly in the end view of FIG. 4. The raised portion 276 extends up into the concave contour of the user's palm to provide additional support for the palm. The width of the palm support 274 is sufficiently narrow that the user's fingers move freely without contacting the palm support 274.

In preferred embodiments, the portions of the cradles 260, 262 in contact with the user's forearms and hands are lined with a material to provide comfortable support for the user. For example, the low-friction neoprene (e.g., wetsuit) material that covers the adjustable pad 204 can also be used to cover the inner portions of the cradles 260, 262.

When the user positions the cradle 260 on the upper portion 205 of the adjustable pad 204, the user's palm is maintained in a generally horizontal position over the keyboard 3 without requiring the user to exert significant effort. Maintaining the wrist in a neutral position reduces strain while operating a keyboard.

As further shown in FIG. 2, the cradle 260 generally rests on the highest point of the upper portion 205 of the adjustable pad 204. Because of the curved contour of the upper portion 205, the area of contact between the cradle 260 and the cover material 250 is much smaller than the area would be if the upper portion 205 was flat. The combination of the low-friction cover material 250 and the small area of contact results in very low friction between the cradle 260 and the cover material 250. Thus, even with the weight of the user's arm and hand resting on the upper portion 205, the user is able to easily move the cradle 260 horizontally on the upper portion 205 (both toward and away from the keyboard 3 and to the left and the right). As illustrated in FIG. 1, the length of the adjustable pad 204 is selected so that the user can move the palm support 274 of right cradle 262 over the pointer support platform 220 and continue to have full support while using the mouse 4 or other pointing device.

By placing the cradles 260, 262 on the adjustable pad 204 as described above, strains to the arms and shoulders of a user are substantially eliminated during the operation of the keyboard. Furthermore, the low-friction interface between the cradles 260, 262 and the cover material 250 allows the user to effortlessly move the hands over the keyboard.

FIGS. 6–12 illustrate an embodiment in accordance with another aspect of the invention. In accordance with the embodiment of FIGS. 6–12, the cradles are not securely attached to the user's forearms. Rather, the cradles are loosely coupled to a horizontal support bar in a position proximate to a keyboard. When the user positions his or her forearms in the cradles, the user is able to move the cradles freely with respect to the support bar so that the user can easily position his or her fingers on the keys of the keyboard.

Figure 6:
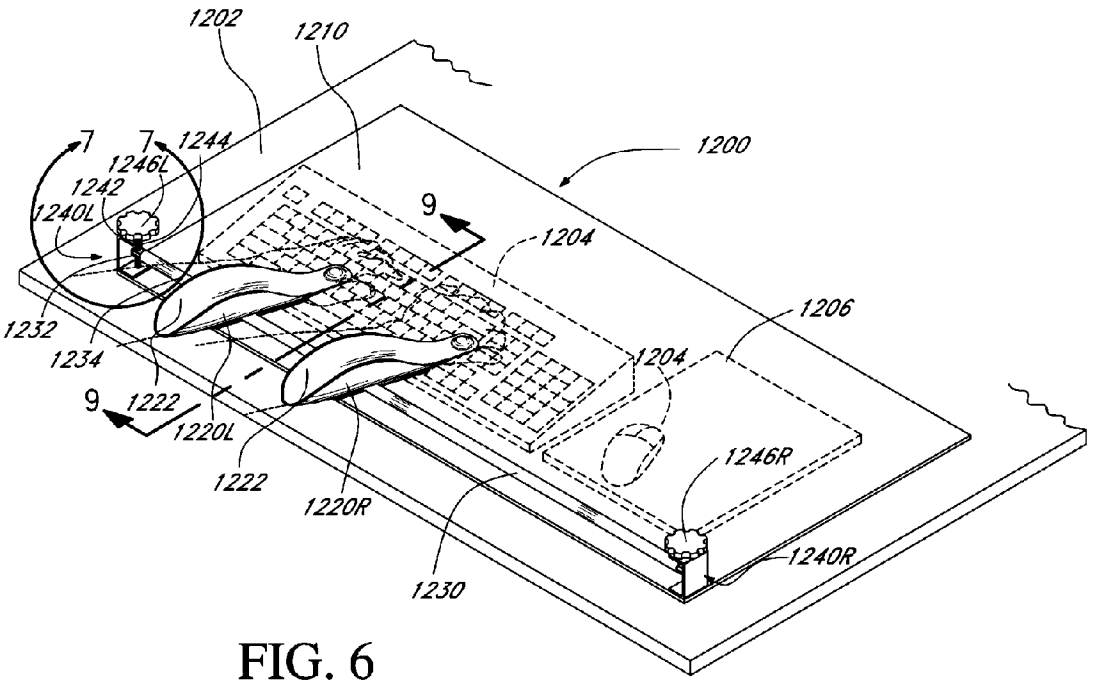
FIG. 6 illustrates a perspective view of an embodiment comprising a horizontal bar to support and retain cradles proximate a keyboard.

As shown in FIG. 6, an adjustable support assembly 1200 rests on a generally horizontal supporting surface 1202 (for example, the upper surface of a desk, a workstation, a table, or the like). The support assembly 1200 includes a planar panel 1210 comprising a plastic material, such as, for example, Lucite®, acrylic, or another suitable lightweight material. In an exemplary embodiment, the panel 1210 has a width of approximately 28–30 inches and has a depth of approximately 12–14 inches. The panel 1210 has a thickness of approximately 0.125 inch and is supported above the surface 2 by a plurality of non-marring standoffs (e.g., feet) 1212 (shown, for example, in FIGS. 8–10). The standoffs 1212 comprise rubber, soft plastic, or the like to provide frictional contact with the supporting surface 1202 to inhibit movement of the panel 1210 with respect to the supporting surface 1202.

In the illustrated embodiment, the panel 1210 supports a keyboard 1204 and a pointing device (e.g., a mouse) 1206. In certain embodiments, the pointing device advantageously rests on a mouse pad 1208. In other embodiments (not shown), the depth of the panel 1210 may be considerably less (e.g., a depth of approximately 3–4 inches) so that the keyboard 1204 rests directly on the supporting surface rather than being supported by the panel 1210. The width of the panel 1210 may also be reduced for use in configurations that do not need to accommodate the additional width of the mouse pad 1208 (e.g., for use with a notebook computer (not shown) having a narrower keyboard and a built-in pointing device.

The adjustable support assembly 1200 comprises a first (left) cradle 1220L and a second (right) cradle 1220R. The cradles 1220L, 1220R are similar to the cradles 260 described above, but have different features (described below) in accordance with the advantageous aspects of the support assembly 1200. The cradles 1220L, 1220R advantageously comprise metal or molded plastic configured to conform to the palm, wrist and forearm of the user. The two cradles 1220L, 1220R could be configured differently for the user's left and right hands; however, in the illustrated embodiment, the two cradles 1220L, 1220R are substantially interchangeable. Thus, the following description of the left cradle 1220L is also applicable to the right cradle 1220R. Each cradle is advantageously lined with a cradle liner 1222, which comprises, for example, neoprene or another suitable cushioning material.

The support assembly 1200 further comprises an adjustable horizontal bar 1230. As shown in more detail in FIGS. 7–10, the horizontal bar 1230 includes an inner cylindrical support rod 1232 having a diameter of approximately 0.375 inch and having a length of approximately 28–32 inches. The central portion of the support rod (approximately 26–28 inches) is surrounded by a thin outer cover 1234. The cover 1234 comprises a low-friction plastic material, such as, for example, polyethylene, a polytetrafluoroethylene resin (e.g., Teflon® fluoropolymer from DuPont), or other suitable material. In a particularly advantageous embodiment, the cover 1234 has a thickness of approximately 0.0625 inch such that the overall diameter of the horizontal bar 1230 is approximately one-half inch.

Figure 8:
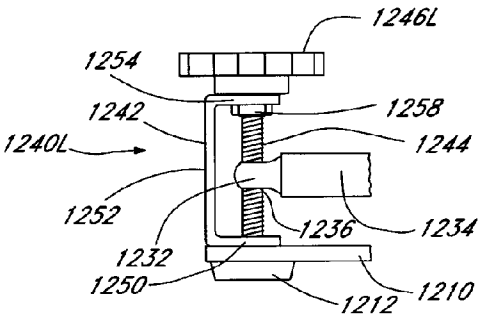
FIG. 8 illustrates an enlarged elevational view of the portion generally encompassed by the arcuate line 8—8 in FIG. 7.
Figure 7:
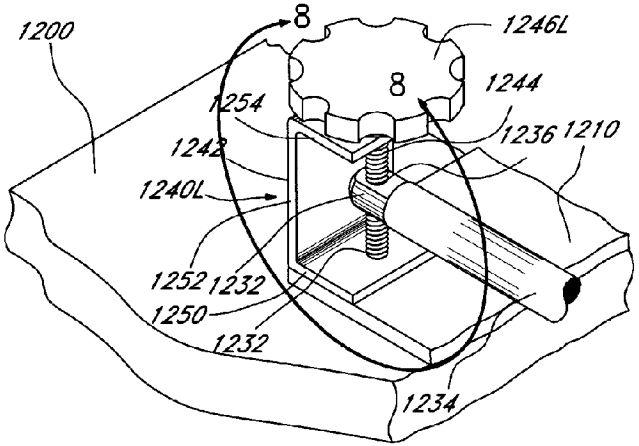
FIG. 7 illustrates an enlarged perspective view of the portion generally encompassed by the arcuate line 7—7 in FIG. 6.

As illustrated in more detail in FIGS. 7 and 8, a portion of each end of the support rod 1232 is not surrounded by the cover 1234. For example, in one exemplary embodiment, the uncovered portion at each end has a length in a range of 0.75 inch to 1.0 inch. As further shown in FIGS. 7 and 8, the uncovered portion is flattened by machining or other suitable techniques and a threaded hole 1236 is formed therein.

The left end of the support bar 1230 is supported by a left height adjustment assembly 1240L. The right end of the support bar 1230 is supported by a right height adjustment assembly 1240R. The two height adjustment assemblies 1240L, 1240R are substantially the same except that the orientations of each assembly are mirrored at each end of the support bar 1230. Thus, the following description of the left height adjustment assembly 1240L also applies to the right height adjustment assembly 1240R.

Figure 9:
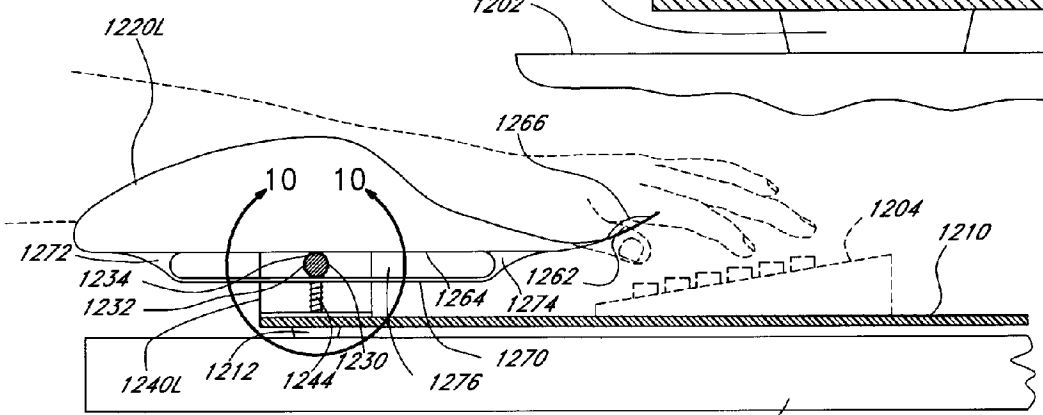
FIG. 9 illustrates an enlarged cross-sectional view taken along the section line 9—9 in FIG. 6.

As shown in more detail in FIGS. 7–9, the left height adjustment assembly 1240L comprises a generally C-shaped bracket 1242 which supports a vertically disposed threaded rod 1244. The rod 1244 in the left height adjustment assembly 1240L is affixed to a left height adjustment knob 1246L. A corresponding threaded rod (not shown) in the right height adjustment assembly 1240R is affixed to a right height adjustment knob 1246R (see FIG. 6). The C-shaped bracket 1242 includes a lower horizontal (base) portion 1250, a vertical portion 1252, and an upper horizontal portion 1254. The base portion 1250 is affixed to the panel 1210 by rivets, screws, epoxy, or another suitable mounting technique.

An upper portion of the threaded rod 1244 passes through an upper hole (not shown) in the upper horizontal portion 1254. A lower end of the threaded rod 1244 rests in a hole or cavity 1256 in the base portion 1250. The diameters of the upper hole and the cavity 1256 are selected to be slightly larger than the outer diameter of the threaded rod 1244 so that the threaded rod 1244 rotates freely about a vertical axis when the height adjustment knob 1246L is rotated by a user. Vertical movement of the threaded rod 1244 is inhibited by a lock nut 1258 or other suitable device positioned on the threaded rod 1244 slightly below the upper horizontal portion 1254. The lock nut 1258 rotates with the threaded rod 1258.

The outer threads of the threaded rod 1244 engage the inner threads of the hole 1236 in the left end portion of the support rod 1232. Thus, as the threaded rod 1244 is turned by the knob 1246L, the left end portion of the rod 1232 is caused to raise or lower in accordance with the direction of rotation. For example, in an exemplary embodiment, the threaded rod 1244 has conventional threads. Thus, clockwise rotation of the knob 1246L causes the left end of the support rod 1232 to move vertically upward with respect to the base portion 1250, and counterclockwise rotation of the knob 1246L causes the left end of the support rod 1232 to move vertically downward with respect to the base portion 1250. Accordingly, a user is able to rotate the two knobs 1246L, 1246R to adjust the support bar 1232 to a desired vertical position. Preferably, a user adjusts the two ends of the support bar 1232 to be at substantially the same level.

As shown in FIGS. 9–12, the cradle 1220L includes a forearm support portion 1260 and a hand support portion 1262. As shown by the end view in FIG. 12, the forearm support portion 1260 is generally U-shaped and has a width selected to accommodate a wide range of forearm sizes. The forearm support portion 1260 has an outer bottom surface 1264 that is generally flat. As shown in FIG. 9, the hand support portion 1262 extends from the bottom surface 1264 and curves upwardly. As described above with respect to the cradle 260, the forward end of the hand support portion 1262 has a raised portion 1266 formed thereon. The location of the raised portion 1266 is selected to be proximate to the palm of a user's hand when the user's forearm is positioned in the forearm support portion 1260.

Figure 10:
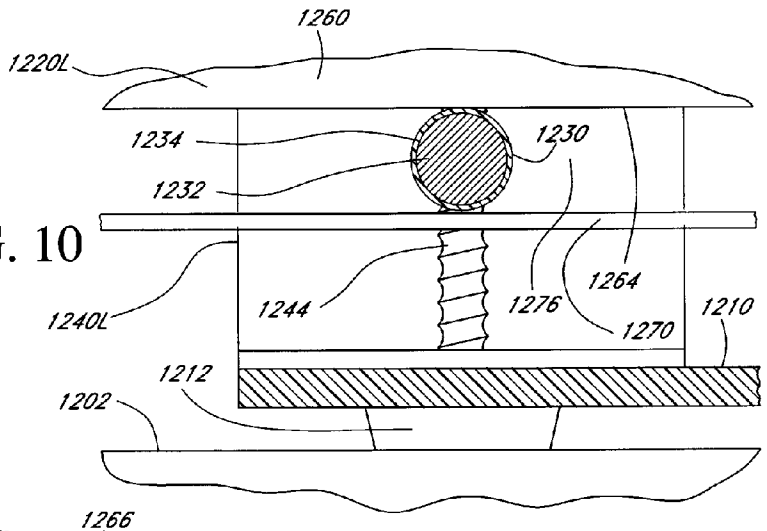
FIG. 10 illustrates a further enlarged cross-sectional view of the portion generally encompassed by the arcuate line 10—10 in FIG. 9.
Figures 11, 12:
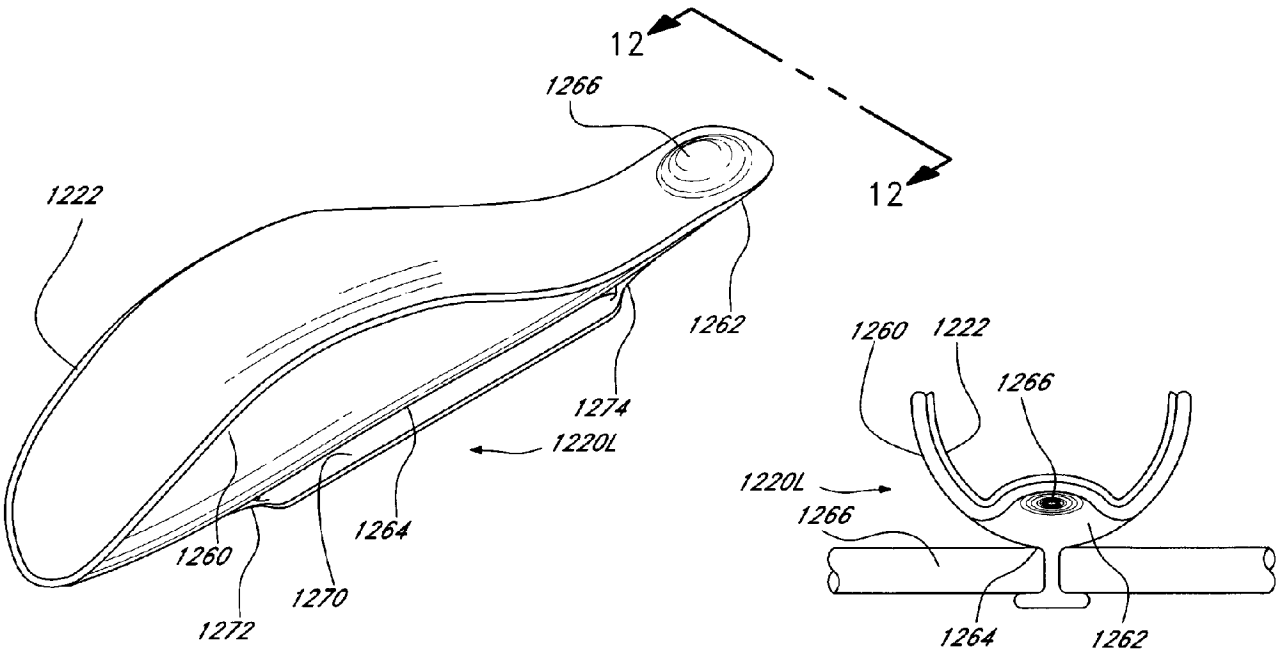
FIG. 11 illustrates an enlarged perspective view of the cradle shown in FIG. 6.
FIG. 12 illustrates an end view of the cradle shown in FIG. 11 in the direction indicated by the view line 12—12.

As shown FIGS. 9–11, the cradle 1220L further includes a retaining bracket 1270 that is parallel to and spaced apart from the bottom surface 1264 of the forearm support portion 1260. The retaining bracket is supported at the rear (in the direction away from the user's hand) by a rear support pylon 1272 and is supported in the front (in the direction toward the user's hand) by a front support pylon 1274. The two pylons 1272, 1274 have heights selected to space the retaining bracket 1270 apart from the bottom surface 1264 by a distance slightly greater than the outside diameter of the cover 1234, as indicated by a gap between the support bar 1230 and the retaining bracket 1270 in the enlarged view of FIG. 10.

The front pylon 1274 is spaced apart from the rear pylon 1272 to provide an unobstructed window (opening) 1276 defined by an unobstructed opening having a length from front to back of approximately 5–6 inches. Thus, the cradles 1220L, 1220R can be moved forward and backward with respect to the support bar 1230 to enable the user's hands to move a sufficient distance to span the distance from the space bar to the function keys of the conventional keyboard 1204. The cradles 1220L, 1220R rotate (tilt) about the horizontal axis of the support bar 1230 to enable the user to adjust the angle of each cradle in a vertical plane. The opening 1276 also enables the cradles 1220L, 1220R to swivel in a generally horizontal plane to enable the user to adjust the angle of his or her arms and hands with respect to each other. Thus, the user can easily use the support system 1200 with a keyboard that has the keys for the left and right hands at different angles. The cradle 1220L and the cradle 1220R are also movable from left to right and from right to left along the support bar 1230 to enable the user to easily engage all the keys of the keyboard 1204 and to also engage the pointing device 1206.

As illustrated in FIGS. 10 and 11, the curved upper surface of the support bar 1230 (see FIG. 10) engages the curved bottom surface 1264 of the cradle 1220L. Thus, the area of contact between the two surfaces is relatively small. In addition, the polyethylene cover 1234 and the plastic or metallic outer shell of the cradle 1220L are smooth and engage with relatively low friction. The combination of low friction materials and a very small area of contact enable a user to move his or her hands effortlessly along the support bar 1230 while performing repetitive tasks.

One skilled in art will appreciate that the foregoing embodiments are illustrative of the present invention. The present invention can be advantageously incorporated into alternative embodiments while remaining within the spirit and scope of the present invention, as defined by the appended claims.

What is claimed is:

1. A system for supporting the forearms and hands of a user performing repetitive tasks, comprising:

a horizontal support bar having a curved upper surface, at least the upper surface comprising a low-friction material; and first and second cradles loosely coupled to the support bar for independent movement with respect to the upper surface of the support bar to enable the cradles to be moved along the support bar, to be moved perpendicular to the support bar, to be swiveled to angles with respect to the support bar, and to be tilted about a longitudinal axis of the support bar, each of the first and second cradles comprising:

a first portion to support the lower portion of the forearm of a user, the first portion having a curved lower surface that has a single small area of contact with the curved upper surface of the support bar; and a second portion to support the hand of the user.

2. The system as defined in claim 1, wherein the low-friction upper surface material comprises polyethylene.

3. The system as defined in claim 1, wherein the support bar has a height above a surface, and the height is adjustable by rotating at least one knob.

4. The system as defined in claim 1, wherein each cradle further includes a retaining bracket disposed below the curved lower surface of the first portion, and wherein each cradle is positioned on the support bar with the support bar disposed between the curved lower surface and the retaining bracket.

5. The system as defined in claim 1, wherein the second portion includes a raised portion positioned to engage the palm of a user.

6. The system as defined in claim 1, wherein the support bar is cylindrical and at least a portion of the outer surface of the support bar is covered with the low-friction material.

7. The system as defined in claim 6, wherein the low-friction material is polyethylene.

8. The system as defined in claim 6, wherein the low-friction material is a polytetrafluorethylene (PTFE) resin.

9. A system for supporting the forearms and hands of a user performing repetitive tasks, comprising:

a horizontal support bar having a curved upper surface, at least the upper surface comprising a low-friction material, wherein the support bar has a height above a surface, and the height is adjustable by rotating at least one knob, and wherein the knob turns a rod in threaded engagement with at least one end of the support bar; and first and second cradles loosely coupled to the support bar for independent movement with respect to the upper surface of the support bar, each of the first and second cradles comprising:

a first portion to support the lower portion of the forearm of a user, the first portion having a curved lower surface that has a small area of contact with the curved upper surface of the support bar; and a second portion to support the hand of the user.

10. A method for reducing strains on the arms and shoulders of a user performing repetitive tasks such as typing and data entry, comprising:

positioning a support bar proximate a keyboard and generally in parallel to the front edge of the keyboard, the support bar having a curved upper surface comprising a low-friction material;

mounting a first cradle and a second cradle on the support bar, the first cradle and the second cradle loosely coupled to the support bar to enable free and independent movement with respect to the support bar, each of the first and second cradles having a forearm support portion to support a user's forearm and a hand support portion to support a user's hand, the forearm support portion of each cradle having a curved lower surface that rests on the curved upper surface of the support bar at a single small area of contact;

positioning the user's left forearm in the forearm support portion of the first cradle such that the user's left hand is supported by the hand support portion of the first cradle with the fingers of the left hand proximate a keyboard, the first cradle supporting at least a portion of the weight of the user's left arm and left hand, the single small area of contact of the first cradle with the support bar enabling the first cradle to be moved along the support bar, to be moved perpendicular to the support bar, to be swiveled to angles with respect to the support bar, and to be tilted about a longitudinal axis of the support bar while the user performs the repetitive tasks; and positioning the user's right forearm in the forearm support portion of the second cradle such that the user's right hand is supported by the hand support portion of the second cradle with the fingers of the right hand proximate the keyboard, the second cradle supporting at least a portion of the weight of the user's right arm and right hand, the single small area of contact of the second cradle with the support bar enabling the second cradle to be moved along the support bar, to be moved perpendicular to the support bar, to be swiveled to angles with respect to the support bar, and to be tilted about a longitudinal axis of the support bar while the user performs the repetitive tasks.

* * * * *